US009517655B2

(12) United States Patent
Manach

(10) Patent No.: US 9,517,655 B2
(45) Date of Patent: Dec. 13, 2016

(54) DISPLAY FRAME

(71) Applicant: Vivian Manach, Homestead, FL (US)

(72) Inventor: Vivian Manach, Homestead, FL (US)

( * ) Notice: Subject to any disclaimer, the term of this patent is extended or adjusted under 35 U.S.C. 154(b) by 0 days.

(21) Appl. No.: 14/960,188

(22) Filed: Dec. 4, 2015

(65) Prior Publication Data

US 2016/0214426 A1 Jul. 28, 2016

Related U.S. Application Data

(60) Provisional application No. 62/087,481, filed on Dec. 4, 2014.

(51) Int. Cl.
*B44C 5/02* (2006.01)
*A47G 1/06* (2006.01)

(52) U.S. Cl.
CPC ..... *B44C 5/02* (2013.01); *A47G 1/065* (2013.01); *A47G 2001/0677* (2013.01)

(58) Field of Classification Search
CPC .... B44C 5/02; A47G 1/065; A47G 2001/0677
See application file for complete search history.

(56) References Cited

U.S. PATENT DOCUMENTS 722,592 A * 3/1903 Kostka ..... G09F 7/08 40/620
1,983,994 A 7/1931 Raynor
3,958,352 A 5/1976 Eubank, Jr.
4,045,266 A 8/1977 Hewitt, Jr.
4,149,332 A * 4/1979 Horwitt ..... A47G 1/18 40/761
4,542,051 A * 9/1985 Cirimele ..... B44C 3/12 40/489
4,821,438 A 4/1989 Lansky
5,384,999 A 1/1995 Roche et al.
5,441,239 A * 8/1995 Watson ..... E04H 17/02 256/1
5,619,816 A * 4/1997 Ellison ..... A47G 1/141 40/738
7,059,073 B2 6/2006 Beach
8,322,667 B2 * 12/2012 Zannoni ..... A47G 23/0225 248/220.41
2005/0274937 A1 * 12/2005 Moore ..... E04H 17/066 256/1

* cited by examiner

*Primary Examiner* — Gary Hoge
(74) *Attorney, Agent, or Firm* — Calrie Marsh, Esq.

(57) ABSTRACT

The invention disclosed herein is comprised of a frame and high tension strings combined to create a useful, distinct and novel display frame. The high-tension strings are interwoven vertically and horizontally across the surface area within the perimeter of the frame, creating vertices and slots for securely holding art objects, such as photographs. The vertical and horizontal high tension strings are affixed to the backside of the frame with a fastener and further secured by intricate knots to prevent the shifting and moving of the strings. The high tension strings are strung at the highest tension and are specifically spaced to accommodate pictures of varying sizes. The specific sized slots created by the interweaving of the vertical and horizontal strings make it easy and simple to slip pictures in and out of the available slots, or rotate the pictures to display in a collage format.

14 Claims, 6 Drawing Sheets

DISPLAY FRAME

CROSS-REFERENCE TO RELATED APPLICATIONS

This application claims the benefit of U.S. Provisional Application No. 62/087,481 filed on Dec. 4, 2015. The entire disclosure of this prior application is hereby incorporated by reference.

STATEMENT REGARDING FEDERALLY SPONSORED RESEARCH OR DEVELOPMENT

This invention has been created without the sponsorship or funding of any federally sponsored research or development program.

FIELD OF THE INVENTION

The present invention relates generally to a display frame.

BACKGROUND

This invention relates to a picture frame for displaying photographs in a collage format and in a manner that is aesthetically pleasing for mounting as art in homes, offices, and other areas. It is well known that collages consist of a plurality of art objects, including photographs mounted in relationship to each to other to provide an aesthetically pleasing art piece. The art objects of a collage are usually mounted on a background material or backing where the art objects are affixed to the backing using a form of adhesive, pins, hooks, clips, or other fastener. These adhesives and/or fasteners allow the art objects to be removable or repositionable. However, over time and/or with multiple removal and repositioning of the art objects, adhesives lose the ability to keep the art objects affixed to the backing material, resulting in art objects shifting or falling off completely. In addition, with the use of pins, clips and other fasteners, the art objects and the backing material develop dents, holes, become irreparably damaged or altogether lose their pleasing appearance.

It is also well known that with the advent of digital cameras and similar technology, printing and framing pictures has become a lost art form. Digital photograph frames exist, but are limited as they generally only show one photograph at a time in a slide show format and are not capable of being displayed as an aesthetic art piece. This invention is for people who still desire to print and frame pictures in a collage format and have various/multiple pictures displayed at the same time in an aesthetically pleasing manner. The goal of this invention is to simplify the lives of people everywhere by allowing them to have a collage of pictures mounted on their wall in an easy to use, but attractive frame which does not require a glass covering, any backing materials such as mats, foam boards, or any complicated metal tabs.

SUMMARY OF THE INVENTION

The present invention is a picture display frame comprising a frame and high-tension string material interwoven in a horizontal and vertical orientation in the area within the perimeter of the frame. The high tension string material is first strung vertically with specified spacing to accommodate pictures of varying sizes and is affixed to the back of the frame by a staple or metal fastener and further secured by intricate knots to prevent the shifting or moving of the string. The high tension string material is then strung horizontally and interwoven with the vertical strings in order to accommodate the selected picture size and is affixed and secured to the back of the frame in the same manner as described for the vertical lines. The specific sized slots created by the interweaving of the vertical and horizontal strings make it easy and simple to move pictures in and out of the available slots, or rotate the pictures to display them in a diagonal form, and voila and you're done! The slots may be sized to fit either the standard 4"×6" or 5"×7" picture sizes or the slots may be customized to fit other desired picture sizes. Other picture frame styles require fabric, ribbon, clips, clothespins or other unappealing gadgets. The tension of the strings in this invention create a means for securing the pictures without need for any adhesive or other fastener, resulting in an attractive and effortless collage display.

BRIEF DESCRIPTION OF THE DRAWINGS

In describing the invention, reference will at times be made to the accompanying drawings in which.

DESCRIPTION OF THE INVENTION

Before the subject invention is described further, it is to be understood that the invention is not limited to the particular embodiments of the invention described below, as variations of the particular embodiments may be made and still fall within the scope of the invention. It is also to be understood that the terminology employed is for the purpose of describing particular embodiments, and is not intended to be limiting.

The details of one or more embodiments of the invention are set forth in the accompanying drawings and the description below. Other features, objects, and advantages of the invention will be apparent from the description and drawings, and from the claims. In the following description, numerous specific details are set forth to provide a thorough understanding of the embodiments. One skilled in the art to which this invention belongs will recognize, however, that the techniques described can be practiced without one or more of the specific details, or with other methods, components, materials, etc. In other instances, well known structures, materials or operations are not shown or described in detail to avoid obscuring certain aspects.

In this specification, the singular forms "a," "an" and "the" include plural reference unless the context clearly dictates otherwise. Unless defined otherwise, all technical and scientific terms used herein have the same meaning as commonly understood to one of ordinary skill in the art to which this invention belongs.

Figure 1:
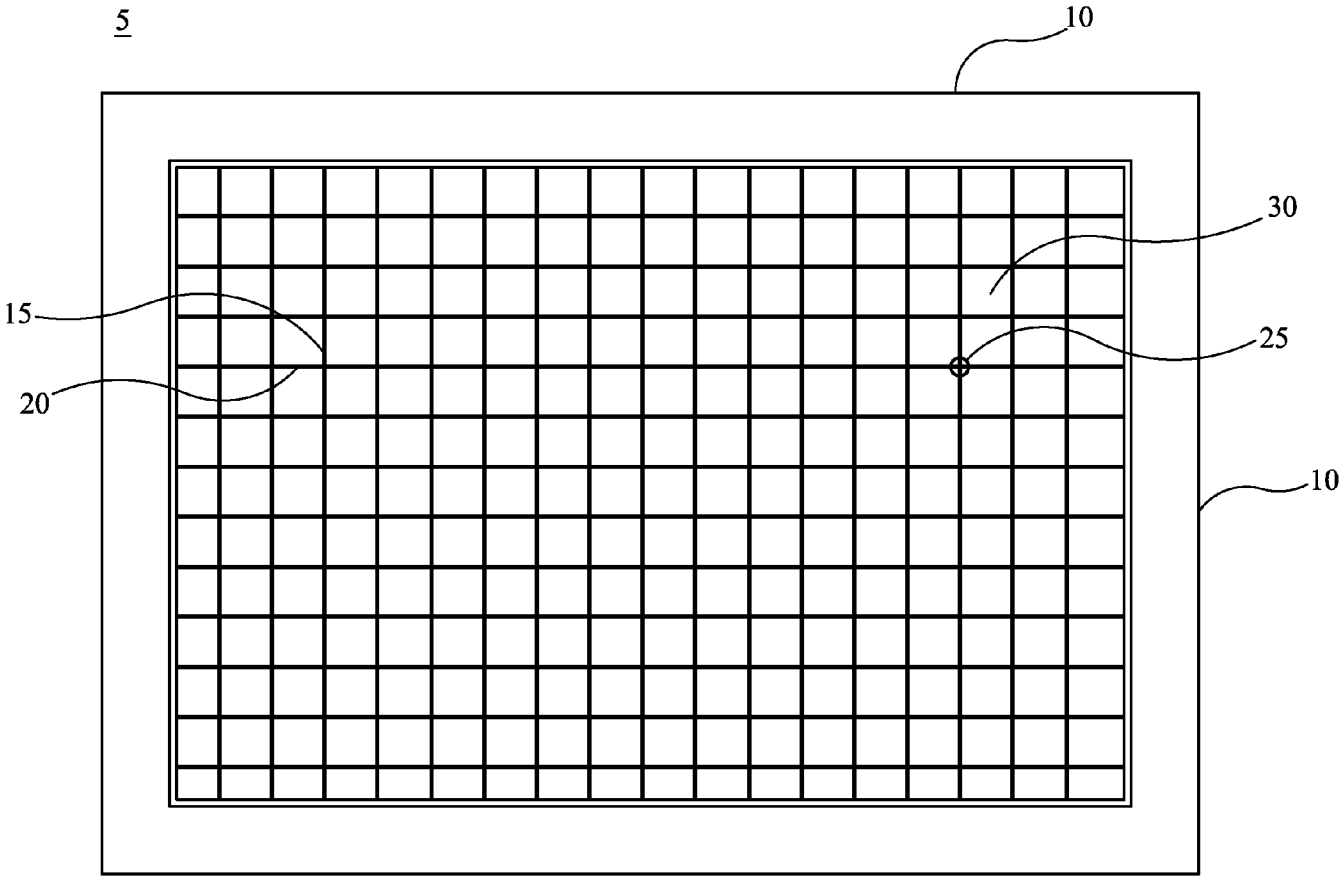
FIG. 1 is a front view of the invention showing the components thereof.
Figure 2:
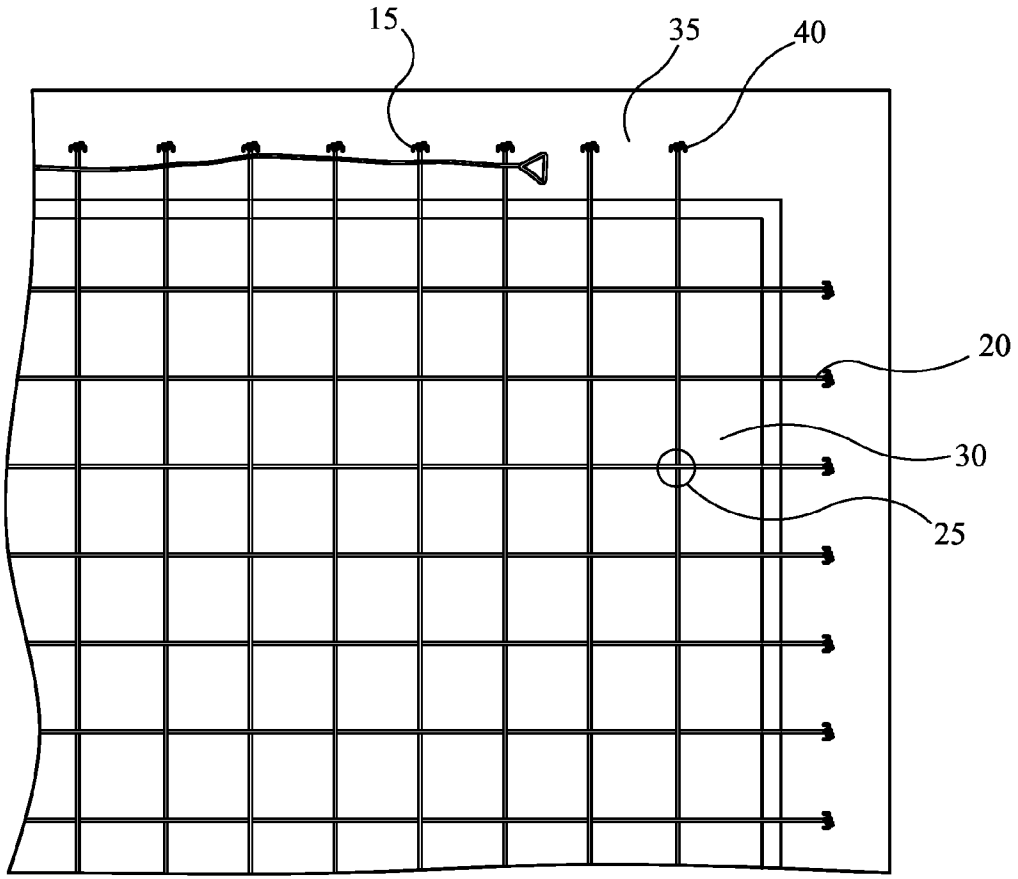
FIG. 2 is a view of the back of the invention showing the interwoven horizontal and vertical high tension strings fastened to the backside of the frame.
Figure 3:
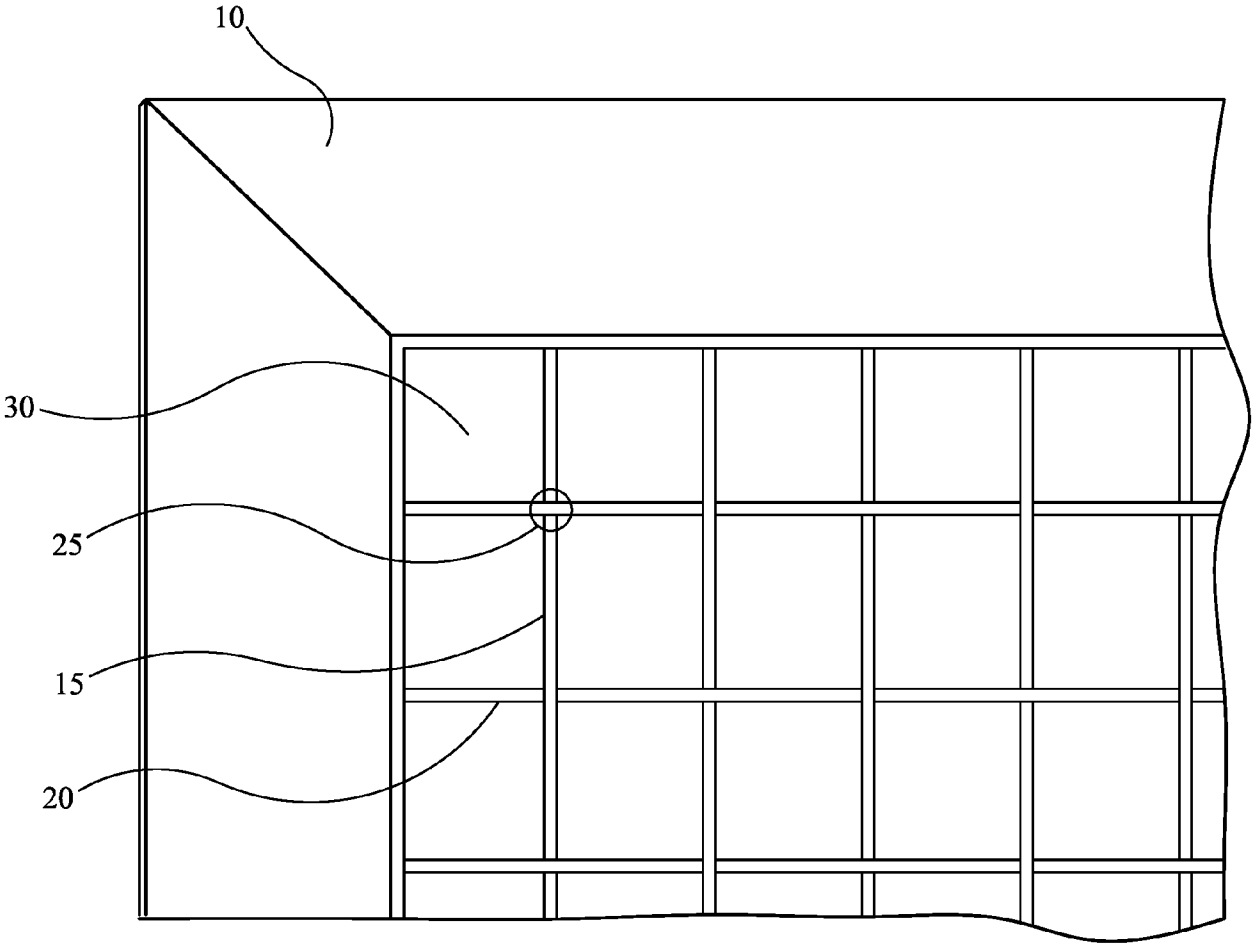
FIG. 3 is an up close view of the front left corner of the invention showing the frame and the seamless appearance of the interwoven horizontal and vertical high tension strings.
Figure 4:
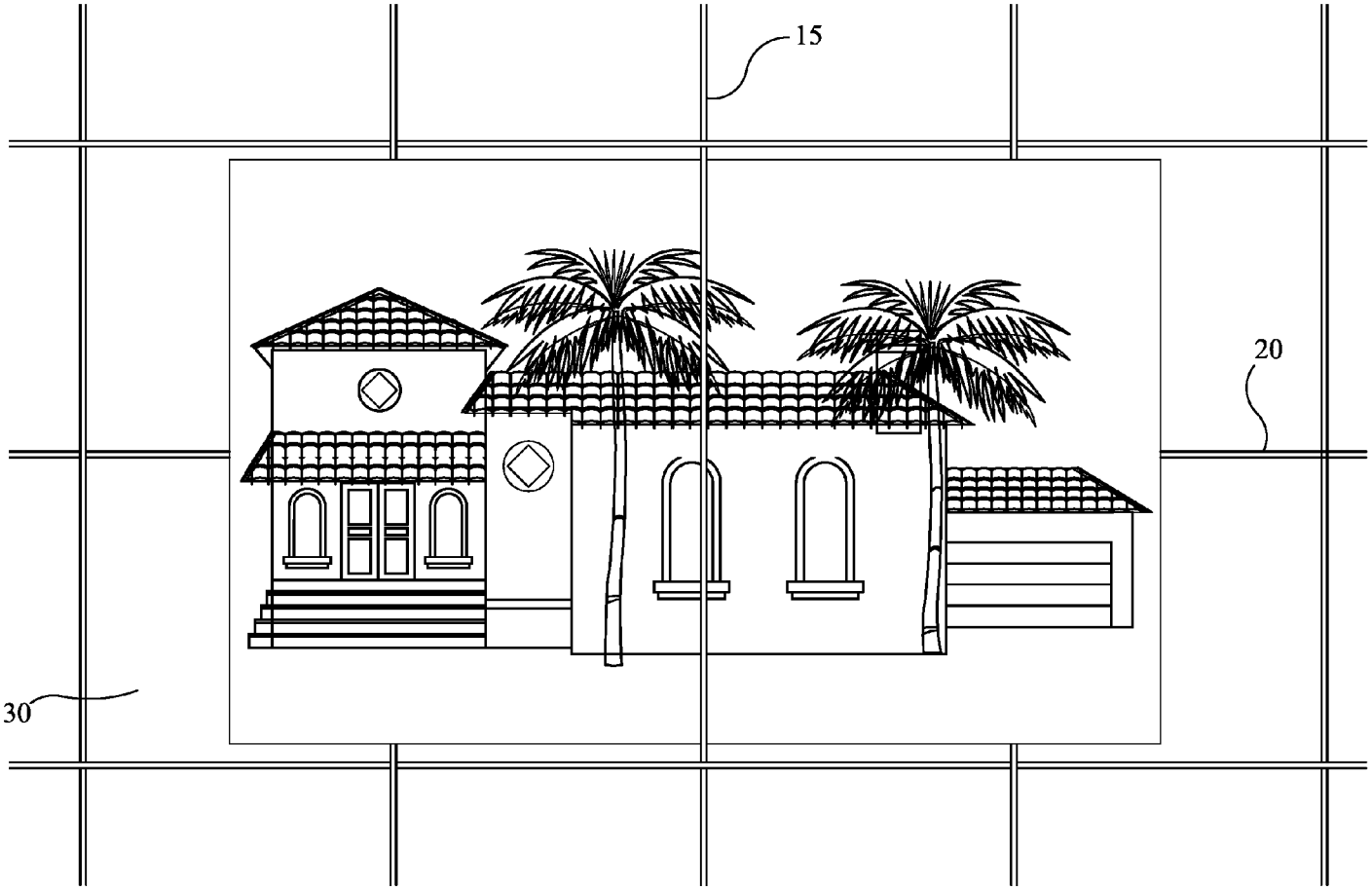
FIG. 4 is a front view of the invention displaying a photograph.
Figure 5:
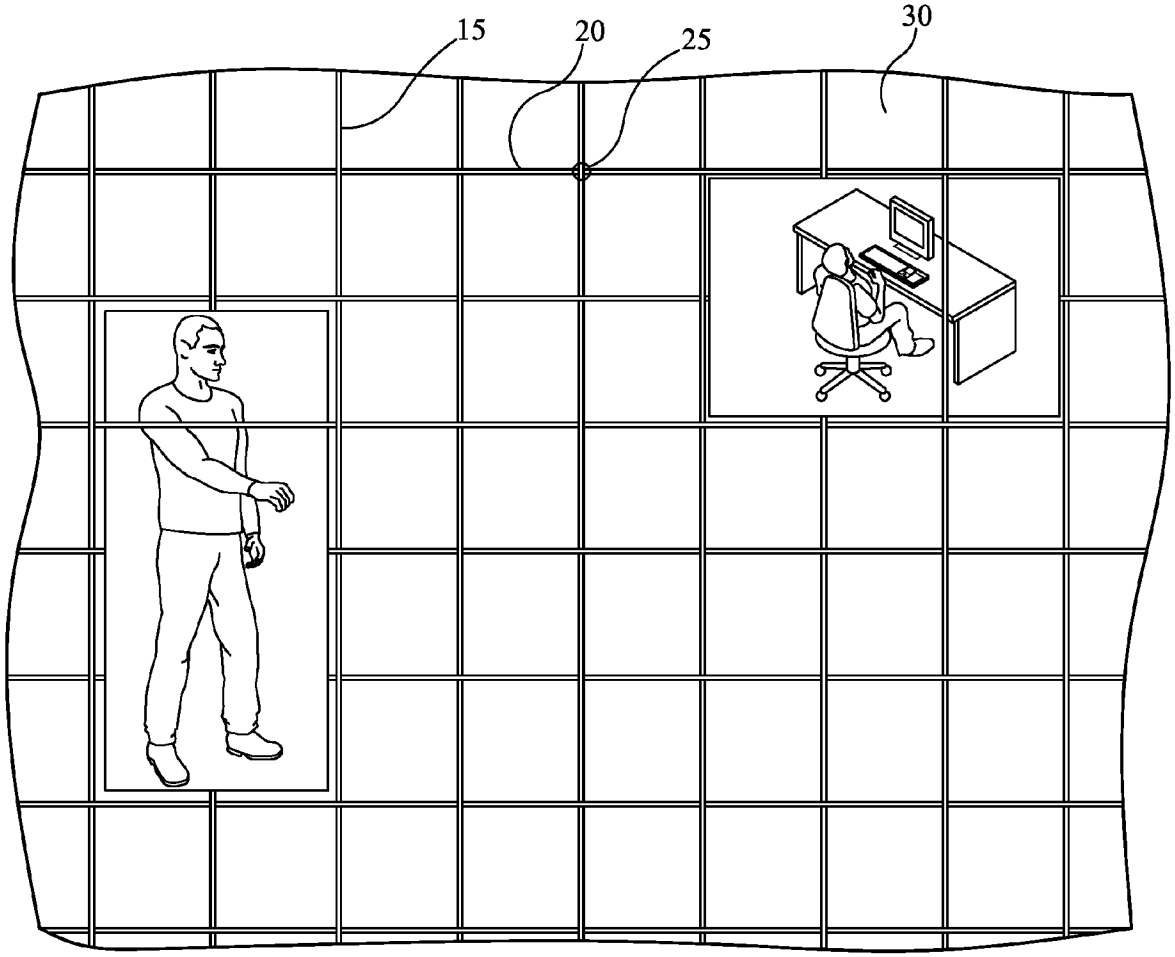
FIG. 5 is a front view of the invention displaying two photographs.
Figure 6:
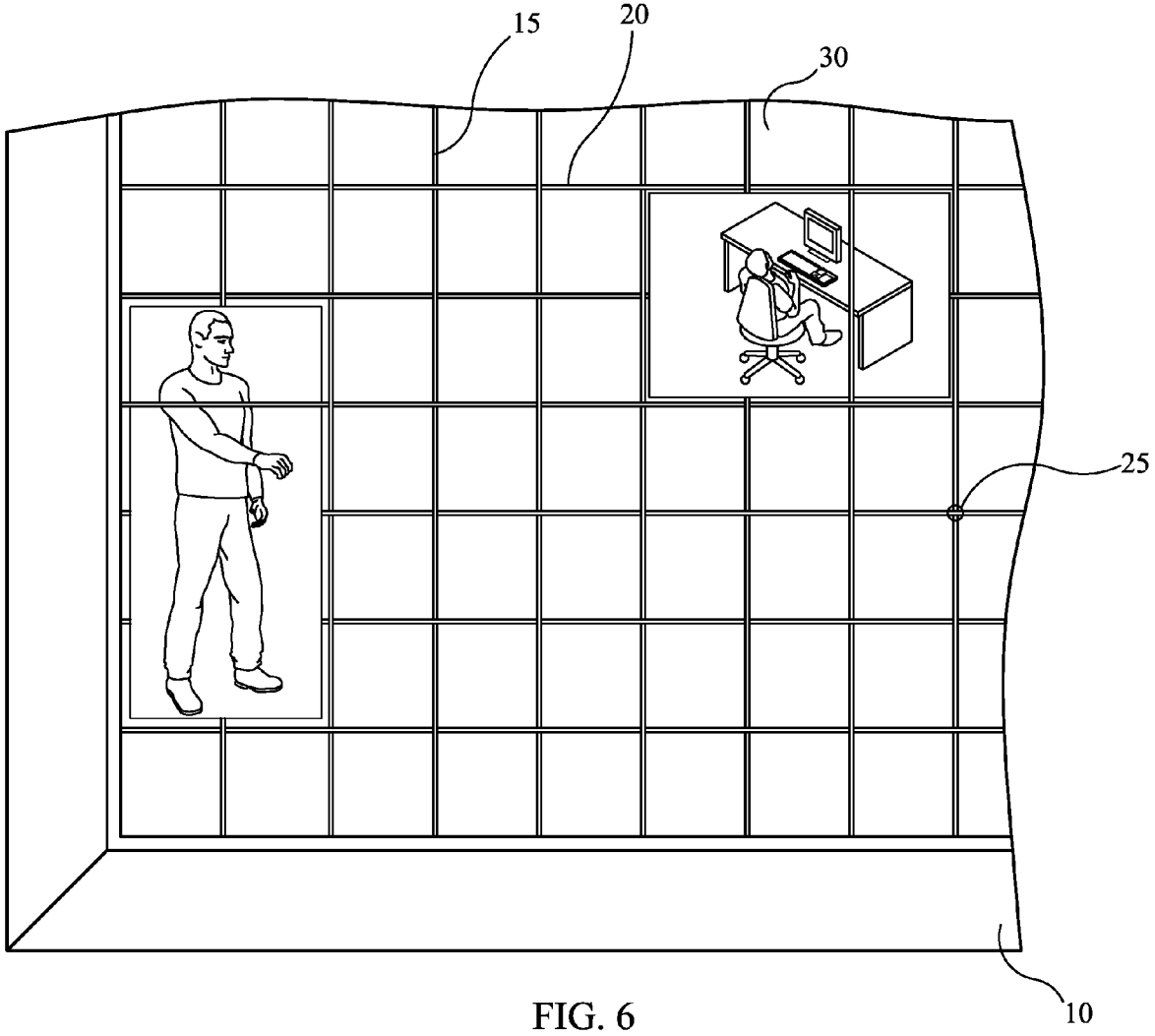
FIG. 6 is a front view of the invention displaying multiple photographs.

The invention is comprised of two main components combined to create a useful, distinct and novel picture frame 5. As shown in FIG. 1, the main components of this invention are a frame 10 and high-tension strings 15, 20 interwoven in a horizontal 20 and vertical 15 orientation in the area within the perimeter of the frame 5. As shown in FIG. 2, the high tension strings 15, 20 are first strung vertically 15 with specified spacing to accommodate pictures of varying sizes, and is affixed to the backside 35 of the frame 5 by a staple and/or metal fastener 40, and is further secured by intricate knots to prevent shifting/movement of the string. The high tension strings 15, 20 are then strung horizontally 20 and interwoven with the vertical strings 15 in order to accommodate the selected picture size and is affixed and secured to the backside 35 of the frame 5 in the same manner as described for the vertical lines 15. As shown in FIG. 3, the interwoven high tension strings 15, 20 intersect to create a vertex 25 that serves to securely hold photographs as they are inserted positioned into the frame 5. The specific sized slots 30 created by the interweaving of the vertical 15 and horizontal 20 strings make it easy and simple to move pictures in and out of the available slots 30, or rotate the pictures to display them in a diagonal form. The slots 30 may be sized to fit the standard 4"×6" picture, as shown in FIGS. 4, 5, and 6; or the 5"×7" picture size. Otherwise the slots 30 may be customized to fit other desired picture sizes.

This picture frame 5 may vary in the display size, photograph size, shape, and material. In one embodiment of the invention, the photograph size is 4"×6" and each high tension string 15, 20 must be set exactly two inches apart horizontally and vertically (FIGS. 4, 5, and 6). As the photograph size changes so does the distance between the vertically and horizontally interwoven high tension strings 15, 20. In another embodiment of the invention, the photograph size may be 5"×7" and each high tension string 15, 20 would be 2.5 inches apart horizontally and vertically.

In other embodiments of the invention the display frame 5 may be of varying size and shape, including but not limited to being square shaped, rectangular, other polygon, or oval. The interweaving of the high tension strings 15, 20 would be adjusted to accommodate the change in size and shape of the display frame 5. Additionally, the display frame 5 may be made of wood, metal, fabric, a combination of materials, plastic, or other material suitable for a display frame. In other embodiments of the invention, the high tension strings 15, 20 may be fastened or affixed to the backside 35 of the display frame 5 using other metal fasteners, an adhesive, or other suitable fastening medium or mechanism. The high tension strings 15, 20 may also be fastened to the backside 35 of display frame 5 by fashioning strategically placed holes in the backside 35 of the display frame for inserting the strings 15, 20 and fastening same to the frame 5 with knots or other fastening means. The high tension strings 15, 20 may be interwoven and attached to the display frame via hand or via machine or a combination of suitable mechanisms.

In all embodiments of this invention the interweaving of the high tension strings 15, 20 is essential to the distinctiveness of the picture frame 5. The high tension strings 15, 20 may be substituted with other suitable material, including but not limited to the same material used in fishing line, which has shown to provide optimum strength and tension to minimize the shifting and moving of the strings on the frame 5 over time and with repeated use. To achieve this feature with fishing lines, the vertical lines must be strung at the highest possible tension, then the horizontal lines must be interwoven with the vertical lines, also at the highest possible tension, as shown in FIGS. 1, 2, and 3. The high tension and interweaving lends to the ease with which pictures are securely positioned into, repositioned, and/or removed from of the slots 30 created by the interweaving of the high tension strings 15, 20 in the area within the perimeter or circumference of the display frame 5, as shown in FIGS. 4, 5, and 6.

The invention as shown in FIGS. 1 through 6 utilizes interwoven fishing line strung from top to bottom (vertically) and from side to side (horizontally), stretched to create a tension level high enough to hold pictures in place without the need for fasteners of any kind.

With the specific design, tension, and spacing of the lines, the possibilities for many different frames are numerous. This would include frames/borders made from various materials as well as utilizing various tensile material instead of the fishing line. Additionally, the components and design of this invention may be customized for display frames of varying sizes (ranging anywhere from poster size to a smaller portrait size), shapes (rectangular, square, oval, etc.), colors, themes (birthday, wedding, baby shower, baby, pets, etc.), and materials (wood, acrylic, metal, plastic, etc.).

The collage display frames described herein would be useful and ideal for anyone desiring to display photographs in a pleasing manner. A user of this invention may be from any age group or stage in life. For example, a college student may customize the frame to include their university's logo, mascot, team emblems, and the like. Alternatively, other users may display their friends and family, vacation shots or pets with ease—adding, removing, and rearranging the photographs. Also, families may be able to easily memorialize and chronicle outings, reunions, special gatherings and memorable moments. All of these potential users would be able to display photographs and other items in an attractive frame that blends in or accents a room's décor, rather than sticking out like sore thumb.

As various changes may be made in the above-described subject matter without departing from the scope and the spirit of the invention, it is intended that all subject matter contained in the above description, or shown in the accompanying drawings, will be interpreted as descriptive and illustrative, and not in a limiting sense.

EQUIVALENTS

Those skilled in the art will recognize, or be able to ascertain using no more than routine experimentation, many equivalents to the specific embodiments of the invention described herein. Such equivalents are intended to be encompassed by the claims.

What is claimed is:

1. A display frame comprising:

a. a polygonal shaped frame, having a front and backside;

b. strings, which are interwoven first vertically, then horizontally over the area within the perimeter of the frame, creating vertices and slots for securely holding photographs without a fastening means;

c. fasteners for affixing the vertically and horizontally strung strings to the backside of the frame; and d. knots made by the vertically and horizontally strung strings, which knots secure the vertically and horizontally strung strings to the fasteners.

2. The display frame of claim 1 wherein the frame is oval shaped.

3. The display, frame of claim 1 wherein the strings consists of fishing line material.

4. The display frame of claim 1 wherein the strings are interwoven 2 inches apart vertically and 2 inches apart horizontally.

5. The display frame of claim 1 wherein, the strings are interwoven 2.5 inches apart vertically and 2.5 inches apart horizontally.

6. The display frame of claim 1 wherein the fasteners consist of a stapling means.

7. The display frame of claim 1 wherein the fasteners consist of a clasping means.

8. A display frame comprising:

a. a frame, having a front and backside;

b. strings, which are interwoven first vertically, then horizontally over the area within the perimeter of the frame, creating vertices and slots for securely holding art objects without a fastening means;

c. fasteners for affixing the vertically and horizontally strung strings to the backside of the frame; and knots made by the vertically and horizontally strung strings, which knots secure the vertically and horizontally strung strings to the fasteners.

9. The display frame of claim 8 wherein the frame is oval shaped.

10. The display frame of claim 8 wherein the strings consists of fishing line material.

11. The display frame of claim 8 wherein the strings are interwoven 2 inches, apart vertically and 2 inches apart horizontally.

12. The display frame of claim 8 wherein the strings are interwoven 2.5 inches apart vertically and 2.5 inches apart horizontally.

13. The display frame of claim 8 wherein the fasteners consist of a stapling means.

14. The display frame of claim 8 wherein the fasteners consist of a clasping means.

* * * * *